US008756852B2

(12) United States Patent
Kramer et al.

(10) Patent No.: US 8,756,852 B2
(45) Date of Patent: Jun. 24, 2014

(54) NON-LETHAL/LETHAL PROJECTILE LAUNCHER RANGING AND SIGHTING SYSTEM

(75) Inventors: Michael T. Kramer, Casper, WY (US); John A. Kapeles, Casper, WY (US)

(73) Assignee: Safariland, LLC, Jacksonville, FL (US)

( * ) Notice: Subject to any disclaimer, the term of this patent is extended or adjusted under 35 U.S.C. 154(b) by 1075 days.

(21) Appl. No.: 12/432,616

(22) Filed: Apr. 29, 2009

(65) Prior Publication Data

US 2012/0210625 A1 Aug. 23, 2012

Related U.S. Application Data

(60) Provisional application No. 61/049,353, filed on Apr. 30, 2008.

(51) Int. Cl.
*F41G 1/12* (2006.01)
*F41G 1/38* (2006.01)

(52) U.S. Cl.
CPC ... *F41G 1/12* (2013.01); *F41G 1/38* (2013.01)
USPC ..... 42/122; 42/130

(58) Field of Classification Search
CPC ..... F41G 1/10; F41G 1/12; F41G 1/38
USPC ..... 42/122, 123, 130, 131
See application file for complete search history.

(56) References Cited

U.S. PATENT DOCUMENTS

| | | | | |
|---|---|---|---|---|
| 3,672,782 | A | 6/1972 | Akin, Jr. | |
| 4,270,293 | A * | 6/1981 | Plumer et al. | 42/105 |
| 5,483,362 | A | 1/1996 | Tai et al. | |
| 5,983,548 | A * | 11/1999 | Ludaescher | 42/1.08 |
| 6,321,479 | B1 | 11/2001 | Sheehan | |
| 6,516,551 | B2 | 2/2003 | Gaber | |
| 6,679,150 | B1 * | 1/2004 | Ramirez et al. | 86/1.1 |
| 7,810,271 | B2 * | 10/2010 | Patel | 42/75.03 |
| 7,966,763 | B1 * | 6/2011 | Schneider et al. | 42/105 |
| 8,333,139 | B2 * | 12/2012 | Addis | 89/14.05 |
| 2005/0024807 | A1 | 2/2005 | Cerovic et al. | |
| 2005/0257414 | A1 * | 11/2005 | Zaderey et al. | 42/122 |
| 2008/0010891 | A1 | 1/2008 | Cole | |
| 2009/0193705 | A1 * | 8/2009 | LoRocco | 42/123 |
| 2011/0203151 | A1 * | 8/2011 | Mossberg et al. | 42/70.01 |

OTHER PUBLICATIONS

International Search Report and Written Opinion for International Application No. PCT/US09/42383, mailed Oct. 13, 2009, 12 pages.

* cited by examiner

*Primary Examiner* — Stephen M Johnson
(74) *Attorney, Agent, or Firm* — Kane Kessler, P.C.; Paul E. Szabo

(57) ABSTRACT

A ranging and sighting system for a lethal and non-lethal projectile launcher having an housing and a eyepiece positioned on an end of the housing and one or more reticles in the eyepiece having separate indicia for sighting a target and ranging a target and a switch for selecting between the indicia for sighting and the indicia for ranging the target.

8 Claims, 11 Drawing Sheets

NON-LETHAL/LETHAL PROJECTILE LAUNCHER RANGING AND SIGHTING SYSTEM

CROSS-REFERENCED TO RELATED APPLICATIONS

This application claims priority to U.S. Provisional Application No. 61/049,353 filed Apr. 30, 2008, the disclosure of which is incorporated herein.

FIELD OF THE INVENTION

The present relates to the field of ranging and sighting systems and more specifically, to a ranging and sighting system capable for use with lethal and non-lethal projectile launchers.

BACKGROUND OF THE INVENTION

Non-lethal projectiles can be lethal at close ranges and ineffective at further ranges and are difficult for use in engaging a target if the distance to the target is unknown. Further, some non-lethal projectiles have significant drop at longer distances because they often travel at lower velocities than lethal projectiles making them less accurate without proper range adjustments for drop of the projectile. Many projectile launchers are used for both non-lethal and lethal projectiles. Therefore, it is important to know the range of the target to adjust for drop and lethality before firing a non-lethal projectile. In order to accurately adjust for the drop of a non-lethal round, the shooter must know the distance to the target. Once the range is determined, the user can insure both accuracy and lethality parameters are being met considering the distance to the target. The accuracy of a non-lethal projectile can be the difference between life and death. Most non-lethal projectiles are designed to hit the body or limbs to incapacitate a subject and a head shot can cause fatal or substantial injury. Thus by ranging the target and accounting for projectile drop over the distance, the probability of an unintended lethal shot is drastically reduced.

Current M203 or M302 military 40 mm grenade launchers use a mechanical flip-up sighting system that is inaccurate and non-ergonomic. In a lethal/non-lethal combination weapon, the grenade launcher mounts under a military rifle such as an M16 or M4. Because lethal and less lethal rounds will be shot at different distances and velocities a mechanical sight is impractical and will not accommodate varying projectile paths. Further, the weight of the lethal and non-lethal projectiles is significantly different which makes the projectile flight paths significantly different from one another. Consequently, a need exists for a ranging and sighting system capable for use, for both lethal and non-lethal projectile launcher weapons.

SUMMARY OF THE INVENTION

The present invention relates to a sighting and ranging system that is designed for use with both non-lethal and lethal projectile launchers. The ranging and sighting device of the present invention allows the user to be able to correctly determine the distance to the target and then allows the user to adjust for the appropriate drop of the projectile being used. The ranging and sighting system of the present invention can use either a custom etched reticle, laser projected sight, laser sight, or a combination thereof. The range indicators are set using the average distance from shoulder to shoulder of a human, the average height of a human or known drop of a particular projectile.

The non-lethal/lethal launcher ranging and sighting system can be designed to range a target by putting marks in the reticle set at known minutes of angle (MOA) that correspond to a known average size of a target. By aligning the target to the correct marks in the sighting and ranging system an accurate distance from the shooter to the target can be determined. The marks can be set up as a go/no-go distance gauge as well as to insure that the target is at a safe distance and not too close to cause lethal damage with a non-lethal projectile.

The ranging and sighting system of the present invention can have more than one adjustment that allows for increased reticle illumination to compensate for high, medium, low or no light conditions. Further, the ranging and sighting system can have settings for night vision. The ranging and sighting system can be mounted directly to a non-lethal launcher with attachments, directly to a picatinny rail, or to the body of the launcher. The ranging and sighting system of the present invention to cross over for use of both lethal and non-lethal projectiles for a combination lethal and non-lethal weapon.

The ranging and sighting system of the present invention will have settings that allow the user to chose a lethal or a non-lethal setting that is specific to the ballistics and drop of the projectile being used. The ranging and sighting system of the present invention provides for the ability to use a lethal platform at long ranges as well as the ability to switch to accurately place non-lethal or less than lethal projectile shots.

DETAILED DESCRIPTION OF THE DRAWINGS

Figure 1:
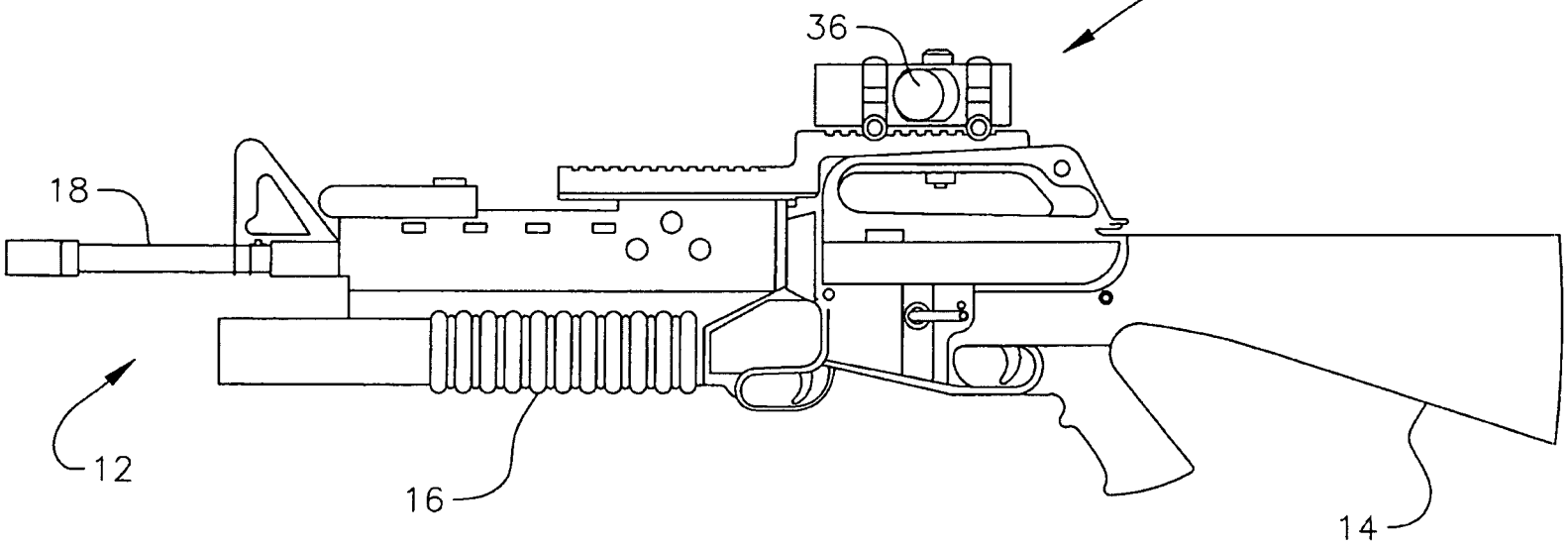
FIG. 1 is side view of the ranging and sighting system attached to a combination lethal and non-lethal weapon.
Figure 2:
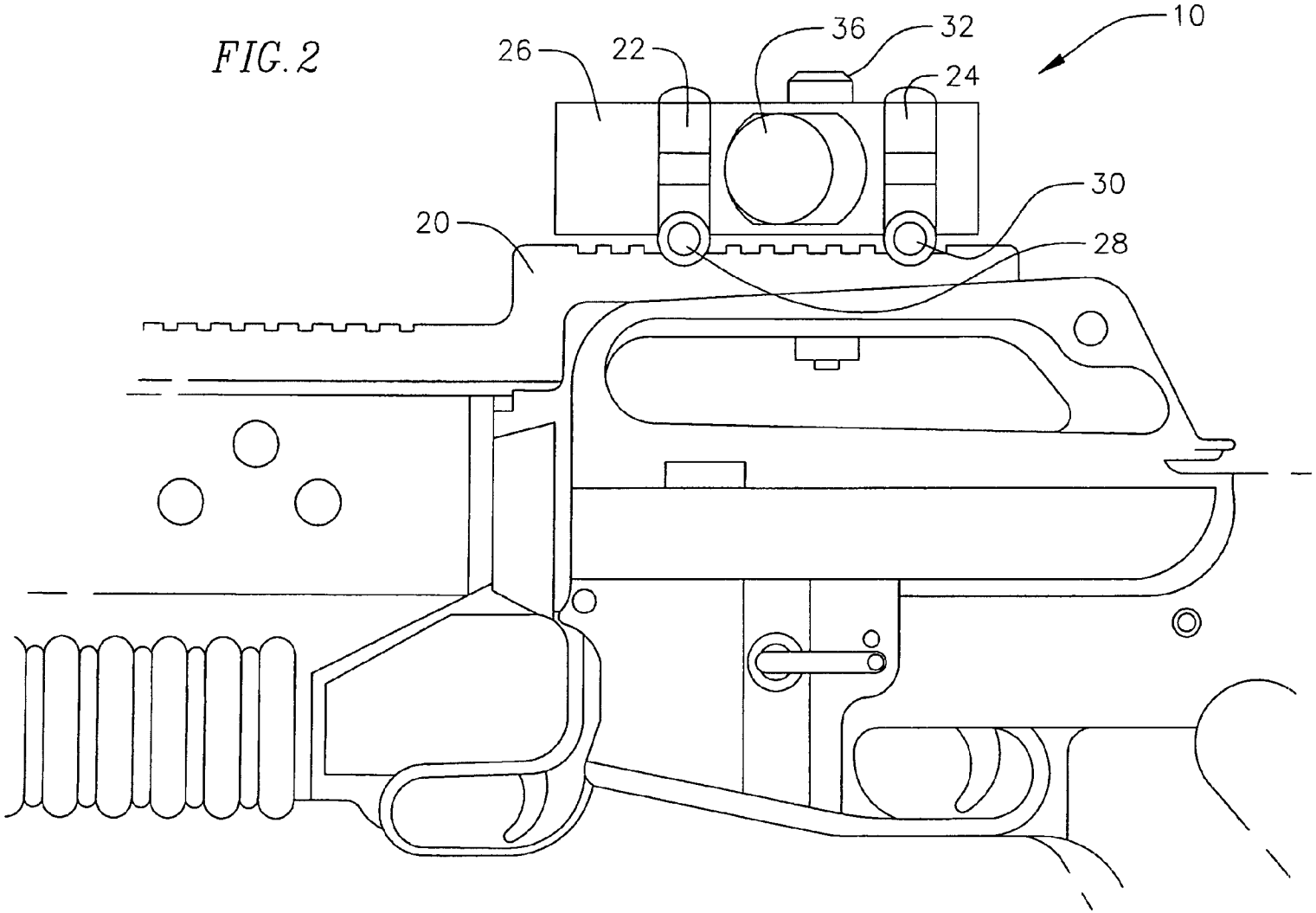
FIG. 2 is a detail side view of the ranging and sighting system of FIG. 1.
Figure 3:
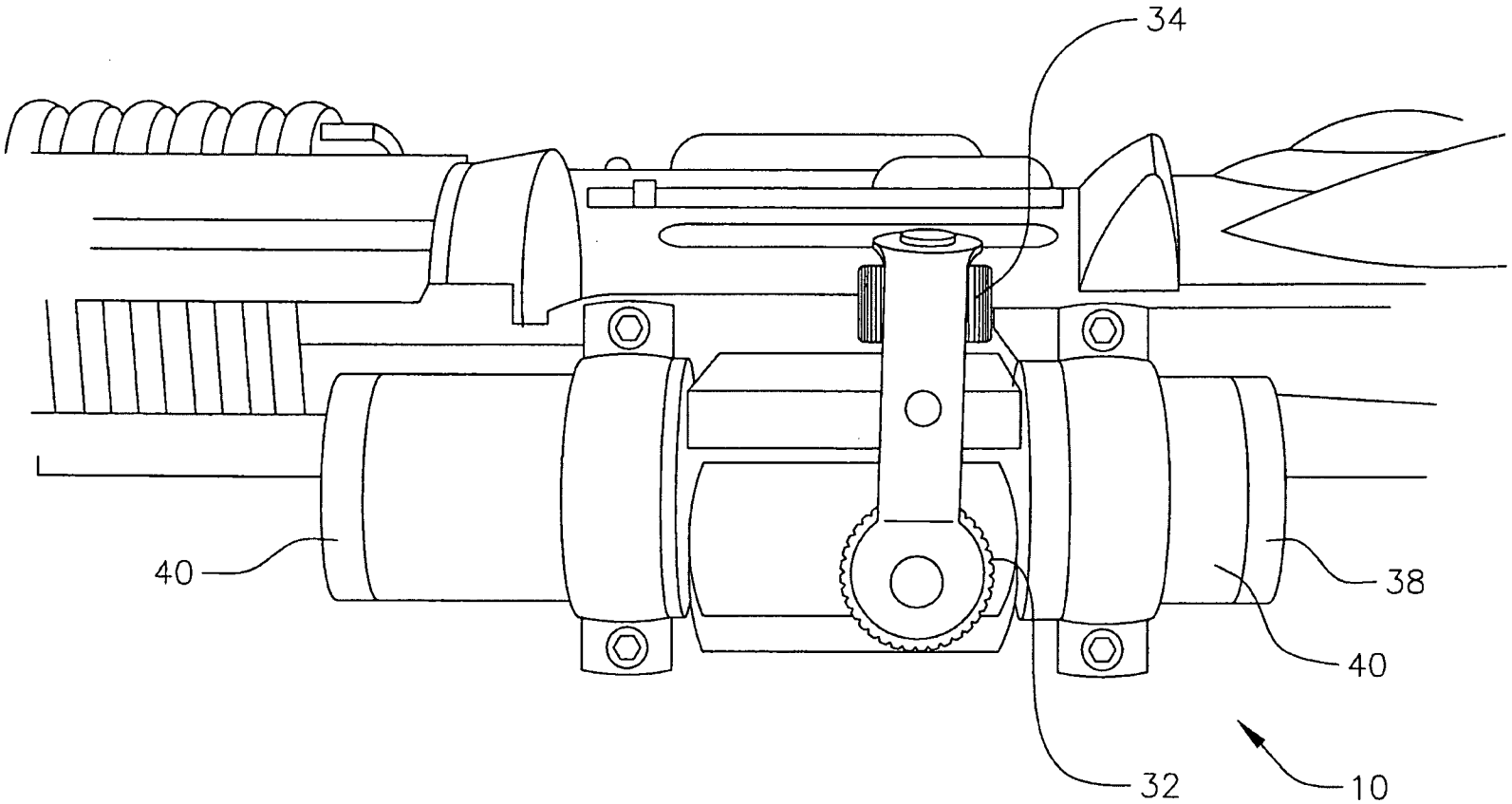
FIG. 3 is a top view of the ranging and sighting system of FIG. 1.

Referring to FIGS. 1 through 3, the ranging and sighting system 10 of the present invention is illustrated as attached to a lethal and non-lethal combination weapon 12. The lethal and non-lethal combination of weapon 12 is a rifle 14 and a grenade launcher 16 positioned below the barrel 18 of the rifle. By way of example, the rifle can be an M16 and the grenade launcher can be a 40 mm grenade launcher. The ranging and sighting system 10 is mechanically fastened to a rail 20 of the rifle. As in common in the industry, the ranging and sighting system 10 is attached to the by rail fasteners 22 and 24 positioned around the main housing 26 which cooperate with adjustable bolts 28 and 30 connected to rail 20.

Positioned on a top surface of the main housing is up/down adjustment knob 32 and positioned on the side of the main housing is left/right adjustment knob 34. Knobs 32 and 34 are used for zeroing the sight on the target. Positioned on the opposite side of left/right adjustment knob 34 is a display pattern select rotary switch 36 which will be discussed in more detailed herein. Positioned on the rear surface of the main housing is the eyepiece 38 which is opposite lens 40 positioned on the front surface of the main housing 26.

The ranging and sighting system 10 can adjust to convert the sighting system for use of lethal projectiles or non-lethal projectiles and can correctly determine the distance to the target and then allow adjustment for appropriate drop of the projectile being used by a custom etched reticle, a laser projected sight, a laser sight or a combination thereof. The ranging and sighting system 10 of the present invention includes a reticle 40 which is a system of lines, dots, cross hairs for wires in the focus of the eyepiece 38. The ranging and sighting system is designed to range a target by putting marks, as shown in the following examples and illustrations, in the reticle set at known minutes of angle (MOA) that correspond to a know average size of a target. By aligning the target to the correct marks in the ranging and sighting system an accurate distance from the shooter to the target can be determined. The marks can be set up as a go/no-go distance gauge as well as to insure that the target is at safe distance and not too close to cause lethal damage with the non-lethal launcher and non-lethal projectile.

The ranging and sighting system can have more than one adjustment that allows for increased reticle illumination to compensate for high, medium, low or no light conditions. Further, the ranging and sighting system can have settings for night vision. The advantage of ranging and sighting system of the present invention is the ranging capability built into the system to prevent lethal shots and the ability of the sighting system to cross over for use of both lethal and non-lethal projectiles.

The ranging and sighting system includes settings that allows the user to choose a lethal or a non-lethal setting by rotation of the display pattern select rotary switch 26 positioned on the housing that is specific to the ballistic and the drop of the projectile being used. One reticle of the sighting system can be used to range a target and adjust for drop when using non-lethal projectiles and then the switch 36 can be rotated, pushed or turned to change the reticle display for use of a lethal round.

Figure 4:
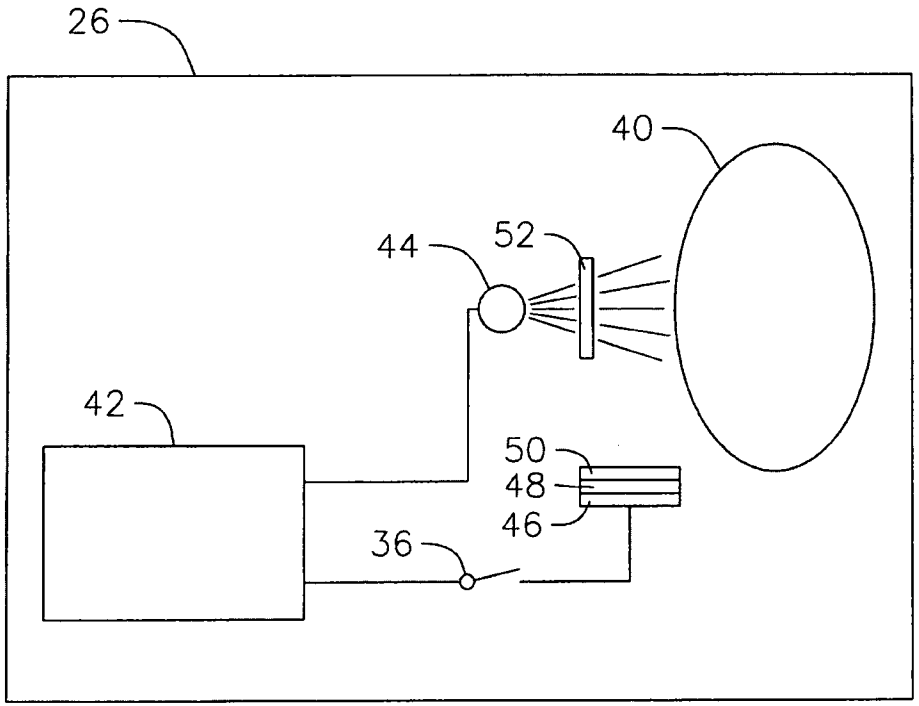
FIG. 4 is a schematic diagram of internal components of the ranging and sighting system of FIG. 1.

As shown in FIG. 4, contained within the housing 26 is a battery 42 which powers a light source 44 to project an image onto the reticle 40. The reticle 40 can be a custom etched reticle or multiple etched reticles or alternatively, the housing can include four plates 46, 48, 50 and 52 each having a different reticle design cut into the plate so that when the rotary switch 36 is operated a new plate is mechanically turned in front of the light source 44 so that the image is projected onto reticle 40. Light source 44 can be a lamp, and a light emitting diode or a laser. As will be more fully understood in the following examples and illustrations, the reticle can include dots, marks or multiple dots and marks for an aim point and the marks on a vertical or a horizontal scale can be used for ranging of a known sized target. The marks can be set with minutes of angle separation or scaled either horizontally or vertically and used to determine the range of a known average size target.

For multiple, selectable displays the images can contain a dot or multiple dots for lethal projectiles and can change to a laser projected display containing two or more dots or marks for sighting of an electrical discharge weapon or an electrical muscular disruption weapon mounted to a lethal projectile shooting system. In this configuration, the dots or marks can indicate the spread of darts fired from an electrical discharge weapon at known distances.

The intensity of the light source contained within the housing can be adjustable to accommodate light intensity onto the reticle for low, medium or high light conditions. The lamp can also be adjustable for night vision setting for no or low light conditions. In addition to marks and dots the reticle can include numbers which would indicate distances which are etched or projected onto the reticle. The marks, dots or numbers projected or etched onto the reticle can indicate drop of a projectile or range of a known average size target. The ranging and sighting system can also include different colors of projected light to differentiate between reticle images for lethal and non-lethal projectiles. The multiple color images or marks can be on single selected reticle or on separate selected reticles. The knobs and switches of the present invention also can control magnification capabilities.

The present invention can further be understood by way of the following examples and illustrations:

EXAMPLES AND ILLUSTRATIONS

Figure 5:
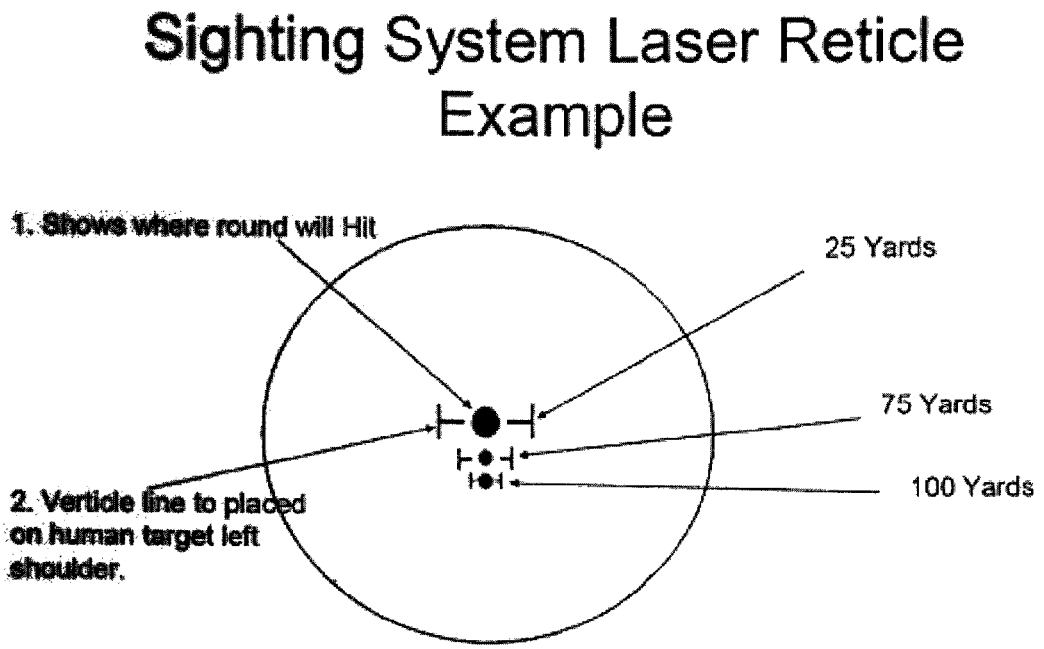
FIG. 5 is a schematic illustration of a first example of a sighting system reticle.

For example in FIG. 5 below, the vertical lines labeled 2 would be used to range by placing the shoulders of the target between the two vertical lines. If that targets shoulders are adjusted to the distance between the vertical lines then the target is at the distance assigned to that specific vertical and horizontal line configuration. For example, if a human targets shoulders filled the distance between the two vertical lines for the 75 yard dot, the shooter would know that the target is at 75 yards and to use that dot for distance drop. The first ranging vertical scale can be used to determine if the target is too close or as a go no/go indicator. If the targets shoulders extend past the vertical lines or marks in the first distance scale the round may be lethal as the target may be too close.

Figure 6:
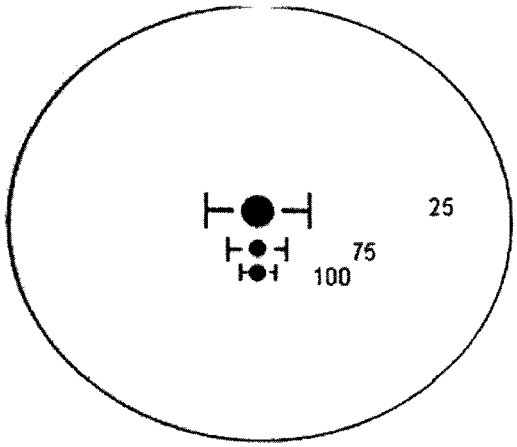
FIG. 6 is a schematic illustration of a second example of a sighting system reticle.

FIG. 6 has numbers (25, 75, and 100) indicating the corresponding range of the target as it fits between the vertical lines shoulder to shoulder. The numbers can range from 0 to 1000 meters or yards.

Figure 7:
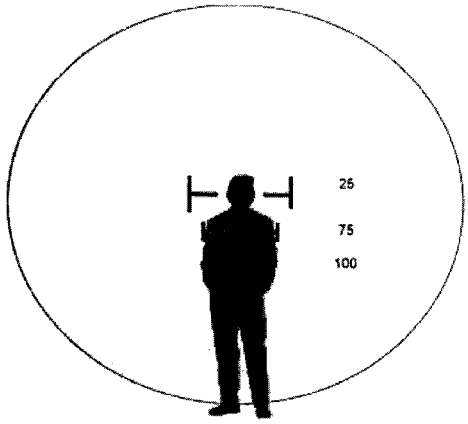
FIG. 7 is a schematic illustration of the reticle of FIG. 6 in use sighting a human.

FIG. 7 shows a human with the 75 meter distance ranging bars matching the targets shoulders. Therefore the shooter would put the 75 meter dot on the target aim paint.

Figure 8:
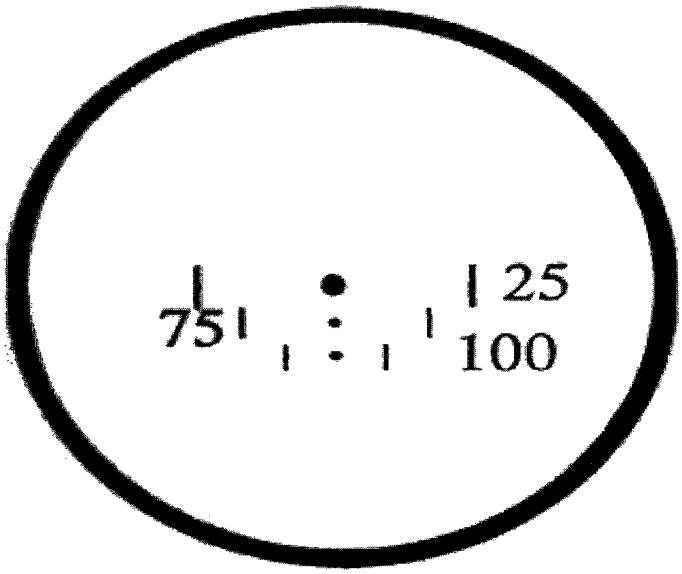
FIG. 8 is a schematic illustration of a third example of a sighting system reticle.

FIG. 8 illustrates a variation without horizontal lines. The vertical lines used for ranging could be dots, lines, ovals, or any other mark used to distance a target with or without numbers.

Figure 9:
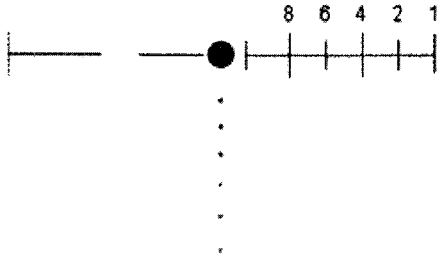
FIG. 9 is a schematic illustration of a fourth example of a sighting system reticle.

FIG. 9 uses vertical lines on a horizontal line for ranging. This sighting system uses dots for aim point however any mark such as a diamond, square, arrow, or other mark could be used.

Figure 10:
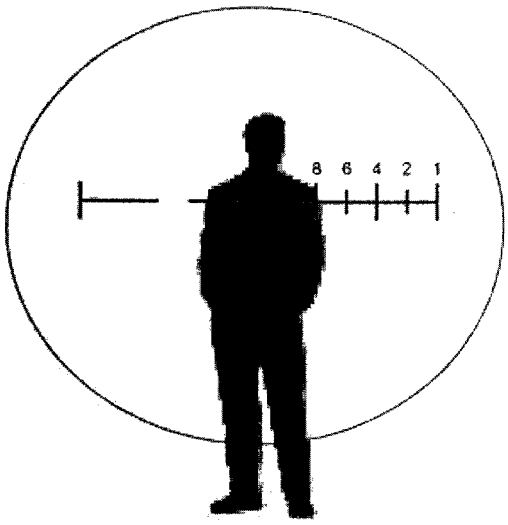
FIG. 10 is a schematic illustration of the reticle of FIG. 9 in use sighting a human.

FIG. 10 could be used to range the target by centering the dot on the chest and determining which vertical mark lines up with the right or left shoulder of the target. In this example the target is at 80 meters.

Figure 11:
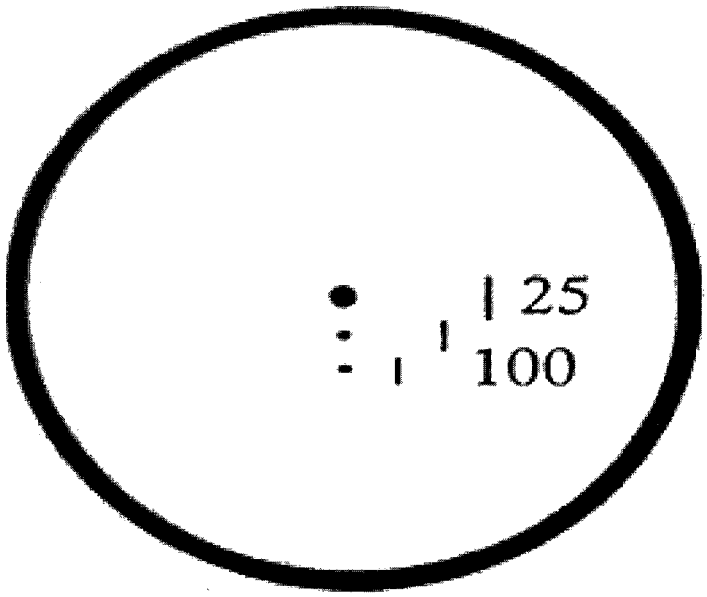
FIG. 11 is a schematic illustration of a fifth example of a sighting system reticle.

FIG. 11 is used in the same fashion as FIG. 10. The dot is centered on the target and the range of the target is determined by which vertical line the target shoulder touches. The ranging vertical lines could be on the right or left side of the aim point. The lines could also be run from top to bottom to allow for ranging using the average height of a human, human torso, or human head. Further the center aim point could be placed on the right or left shoulder and the distance could be determined by marks on a vertical or horizontal scale. Numbers could optionally be included.

Figure 12:
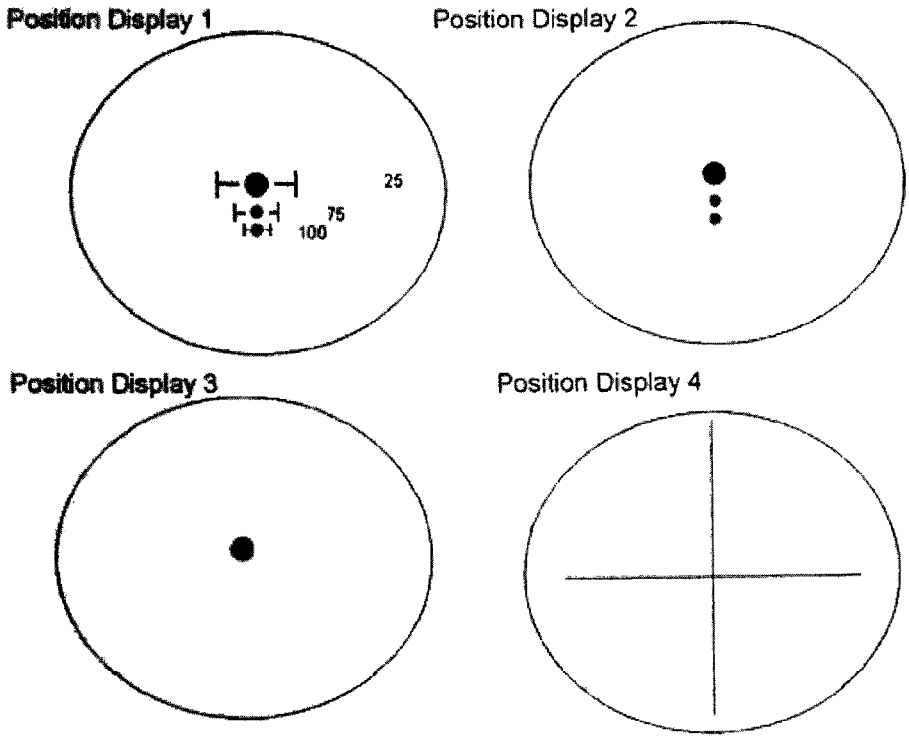
FIG. 12 is a schematic illustration of a sixth example of a sighting system reticle that is a multiple adjustment system.

FIG. 12 depicts a multiple adjustment system. This illustration shows four different displays that could be selected individually with a switch. For example if using a non-lethal projectile the user would set the switch to position 1, 2 or 3. If a lethal round was being used the user would select position 2, 3 or 4. Position 2 could be set up for the drop of a known lethal round such as a .223 M4 projectile used by the military.

Figure 13:
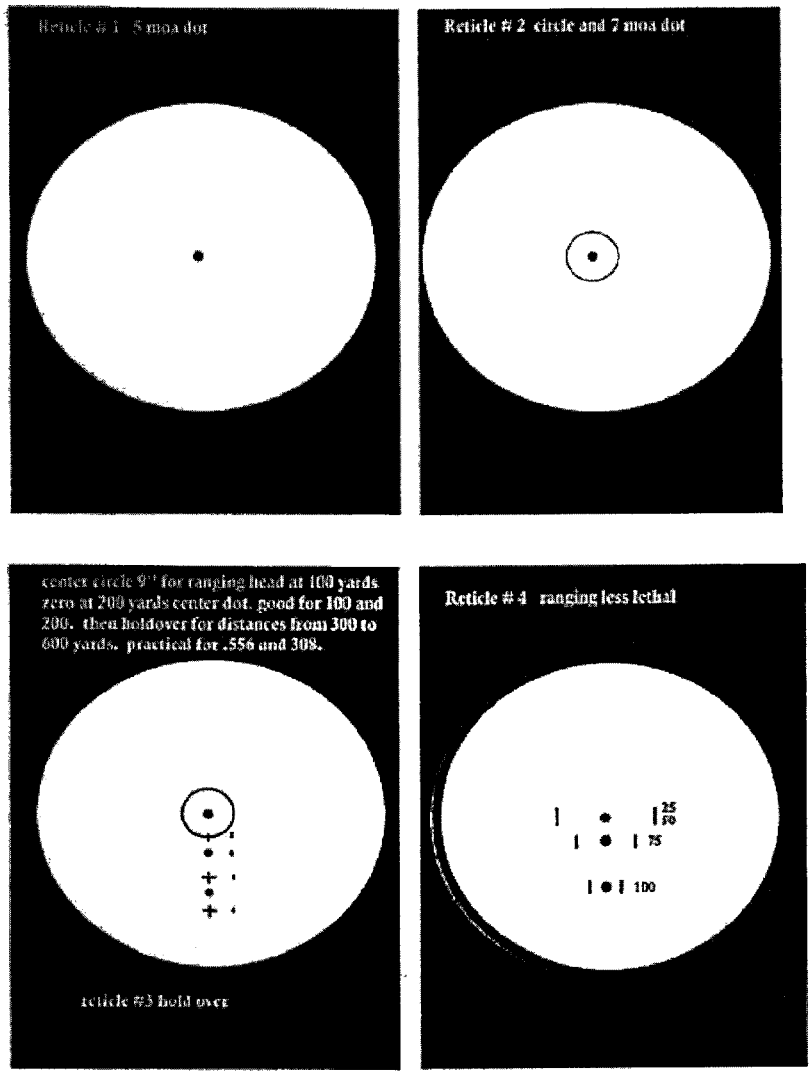
FIG. 13 is a schematic illustration of a seventh example of a sighting system reticle that is a multiple adjustment system.

FIG. 13 depicts another four reticle design. Reticle 3 would be used for lethal sighting for an M16/M4 .223 or .308 caliber for drop out to 600 yards. Reticle 4 would be used for non-lethal ranging of a 40 mm or 12 ga round out to 100 yards. Reticles 1 and 2 would most likely be used for close range lethal and non-lethal projectiles. A single reticle design would use a reticle similar to reticle 4.

Although the present invention has been described and illustrated with various embodiments thereof, it is to be understood that the invention is not to be so limited as changes and modifications can be made herein which are within the intended scope as hereinafter claimed. For example, the ranging and sighting system of the present invention could be adapted for use for a non-lethal weapon, such as a grenade launcher only.

What is claimed is:

1. A ranging and sighting system for a non-lethal projectile launcher having a first barrel, comprising:

a housing;

an eyepiece positioned at one end of the housing; and a reticle in the eyepiece, the reticle having a plurality of vertically spaced ranging bars for sighting and ranging a target by bracketing the target with the ranging bar;

each ranging bar including a horizontal line of a predetermined length with vertical lines at its ends for bracketing the target's shoulders;

the plurality of ranging bars having a plurality of different lengths for bracketing the target's shoulders at different distances, thereby providing an indication of the distance to the target; and each ranging bar having an associated aiming dot for placement on the target aim point when the proper ranging bar is bracketing the target's shoulders;

wherein the weapon further includes a lethal projectile launcher, the weapon having a second reticle and a mechanism for switching between the two reticles with different ranging or sighting marks, one reticle with one set of ranging marks being used for the lethal projectile launcher, and the other being used for the non-lethal projectile launcher.

2. The system of claim 1 further comprising a battery and a light source positioned in the housing for projecting an image onto the reticle.

3. The system of claim 2 wherein the light source for projecting an image onto the reticle is a laser.

4. The system of claim 2 wherein the light source is a lamp and the reticle is etched with the image.

5. The system of claim 2 further comprising means for adjusting the light source onto the reticle for variable light conditions or night vision.

6. The system of claim 2 wherein the light source projects different color images to distinguish between lethal and non-lethal projectiles.

7. The system of claim 1 wherein the non-lethal projectile launcher is an electrical discharge weapon and the system includes indicia on the reticle that indicates spread of darts from an electrical discharge projectile.

8. The system of claim 1 further having means for adjusting magnification, aim point or zeroing of the target.

* * * * *